US005466008A

United States Patent [19]

Ozeki

[11] Patent Number: 5,466,008

[45] Date of Patent: Nov. 14, 1995

[54] FILE SHEET STORING DEVICE

[75] Inventor: Jiro Ozeki, Tokyo, Japan

[73] Assignee: Slidex Corporation, Tokyo, Japan

[21] Appl. No.: 186,416

[22] Filed: Jan. 25, 1994

[30] Foreign Application Priority Data

Feb. 1, 1993 [JP] Japan ..... 5-014773

[51] Int. Cl.[6] ..... B42D 3/00

[52] U.S. Cl. ..... 281/31; 281/38; 402/79

[58] Field of Search ..... 281/31, 38; 402/79, 402/80 P; D19/33; 40/159, 537, 405; 206/455, 472; 383/39; D6/626; D3/35

[56] References Cited

U.S. PATENT DOCUMENTS

| | | | |
|---|---|---|---|
| D. 312,476 | 11/1990 | Westendorff | D19/27 |
| 2,154,510 | 4/1939 | King et al. | 40/159 |
| 4,533,048 | 8/1985 | Ozeki | 206/455 |
| 4,629,070 | 12/1986 | Roberg | 383/38 X |
| 4,911,777 | 3/1990 | Truc et al. | 383/39 X |
| 4,972,952 | 11/1990 | Reisendeder | 206/456 |
| 4,997,089 | 3/1991 | Ozeki | 206/455 |
| 5,127,756 | 7/1992 | Lumm | 402/79 |

FOREIGN PATENT DOCUMENTS

| | | |
|---|---|---|
| 1260731 | 2/1968 | Germany . |
| 8517742 | 10/1985 | Germany . |
| 336799 | 4/1959 | Switzerland . |

OTHER PUBLICATIONS

1989 Jacobs Gardner Office Products Catalog, pp. 797 and 798.

1989 Miller's Office Products Catalog, pp. 528–531.

*Primary Examiner*—Mark Rosenbaum
*Attorney, Agent, or Firm*—Keck, Mahin & Cate

[57] ABSTRACT

A file sheet storing device comprising a first sheet made of a transparent material and adapted to cover one side surface of a file sheet, a second sheet made of a transparent or an opaque material and adapted to cover the other side surface of the file sheet. The first and the second sheets are connected together to form a bag-shaped cover along three edge portions leaving the remaining edge portion at least partially unconnected to provide an opening for insertion of a file sheet. The bag-shaped cover is formed along one of the three edge portions with a bonded portion for binding the cover to a book-shaped binder. The cover is further formed along the edge portion where the bonded portion is provided with a line of attachment between the first and the second sheets for preventing the file sheet from being displaced toward the edge portion where the bonded portion is formed.

5 Claims, 6 Drawing Sheets

FILE SHEET STORING DEVICE

BACKGROUND OF THE INVENTION

1 Field of the Invention

The present invention relates to a file sheet storing device. More particularly, the present invention pertains to a file sheet storing device for storing a file sheet which is adapted to store a plurality of information carrying mediums such as a picture slides in rows and/or columns in a plane. The present invention specifically relates to a file sheet storing device including a plurality of covers each comprising a first sheet and a second sheet which are made of a transparent material and connected together at least at three sides to form a storing bag having an opening at the remaining side for insertion of the file sheet, the storing bag being provided along one of the sides with binding means for making it possible to bind the bag with the file sheet stored therein in a binder.

2 Description of the Prior Art

File sheets adapted to store information carrying mediums such as picture slides in rows and columns are widely used in view of conveniences that the information carrying mediums can be placed on a platen of an optical projector with the mediums held on the file sheet. The file sheet having a plurality of information carrying medium held thereon may be moved on the platen of the projector to place a desired one of the mediums at the projecting position.

It is desired for this type of file sheet to provide a protective covers for covering the both side surfaces of the file sheets so that the information carrying mediums stored thereon can be protected from any possible scratches and/or deposition of dusts thereon. It is also desired that the covers are of transparent material so that the information carrying mediums such as picture slides can be visually observed through the covers.

For the purpose, the Japanese utility model publication Hei 4-14225 which corresponds to the U.S. Pat. No. 4,997,089 issued on May 5, 1991 to the same inventor of the present invention discloses a dust cover for a file sheet. The dust cover of this patent is made of a transparent material and comprises a first sheet adapted to cover one side surface of the file sheet and a second sheet to cover the other side surface of the file sheet. The first and the second sheet of the cover are attached together along three sides leaving an inlet opening formed along the remaining side. A cover flap is provided at the side where the inlet opening is formed. The cover is further formed along the side opposite to the side where the inlet opening is formed with a plurality of cuts at locations corresponding to the binder holes formed in the file sheet which is to be stored in the cover so that the file sheet in the cover can be bound in a binder of a conventional structure.

The dust cover of the known structure has been found satisfactory to a substantial extent, however, problems have been experienced particularly in the case where the file sheets are of relatively rigid structure. It has been experienced that in the case where the file sheet stored in the dust cover is of a rigid structure there is a tendency that the file sheet is shifted in the dust cover under its own weight to a side of the dust cover so that the binder holes in the file sheet cannot be aligned with the cuts formed in the dust cover. In order to avoid such problem, binder holes may be formed in the dust cover along the side thereof. However, this structure is found disadvantageous in that the file sheet stored in the cover has a tendency of being shifted under its weight toward the side portion where the binder holes are provided with the result that the thickness at the side is increased to an extent that it may become difficult to turn the file sheet over another file sheet. This is particularly true in the case where the file sheet is of a relatively rigid structure.

SUMMARY OF THE INVENTION

The present invention has been obtained with a recognition of the aforementioned problems and has an object to provide a file sheet storing device in which the aforementioned problem of prior art can be avoided.

Another object of the present invention is to provide a file sheet storing device which has means for preventing the file sheet stored in the device being shifted toward a side where the binding holes are provided.

According to the present invention, the above and other objects can be accomplished by a file sheet storing device comprising a first sheet made of a transparent material and adapted to cover one side surface of a file sheet, a second sheet made of a transparent material and adapted to cover the other side surface of the file sheet, the first and the second sheets being connected together to form a bag-shaped cover means along three edge portions leaving the remaining edge portion at least partially unconnected to provide opening means for insertion of a file sheet. The bag-shaped cover means is formed along one of the said three edge portions with means for binding the cover means to a binder. The cover means is further formed along the edge portion where the binding means is provided with means for preventing the file sheet from being shifted toward this edge portion.

According to one aspect of the present invention, the preventing means is provided in the form of an attachment between the first and the second sheets along a line which is inwardly spaced from by a predetermined distance and extending substantially along the edge portion where the binding means is formed. In accordance with a specific aspect of the present invention, the opening means for the insertion of the file sheet is formed at an edge portion which is adjacent or perpendicular to the edge portion where the binding means is formed. In this arrangement, the line along which the preventing means is formed is closer to the edge portion having the binding means at a portion adjacent to the opening means to provide a wider opening mouth for the insertion of the file sheet and extends gradually apart away from the edge portion to narrow the space for the insertion of the file sheet as seen in the direction of the insertion.

It is of course possible in accordance with the present invention to provide the line along which the prevention means is formed as a straight line which is parallel with the edge portion where the prevention means is formed. The bag means may in this arrangement be formed with the opening means at the edge portion opposite to the edge portion where the prevention means is formed.

In order to form the prevention means, the first and the second sheets may be sealed together continuously or intermittently. The sealing line can prevent the file sheet stored in the bag means from being shifted toward the side where the binding means is provided. Therefore, an adequate space can be secured between the binding means and the adjacent edge of the file sheet stored in the bag means so that the file sheet and the bag means storing the file sheet can be turned without any difficulty over the file sheet stored in another bag means stored therein and bound in the same binder.

The above and other objects and features of the present invention will become apparent from the following description of preferred embodiments taking reference to the accompanying drawings.

BRIEF DESCRIPTION OF THE DRAWINGS

FIG. 7 (*b*) is a fragmentary side view similar to FIG. 7 (*a*) but showing a file sheet completely inserted into the bag; and, FIG. 8 is a front view showing a file sheet storing device in accordance with a further embodiment of the present invention.

DESCRIPTION OF THE PREFERRED EMBODIMENT

Figure 1:
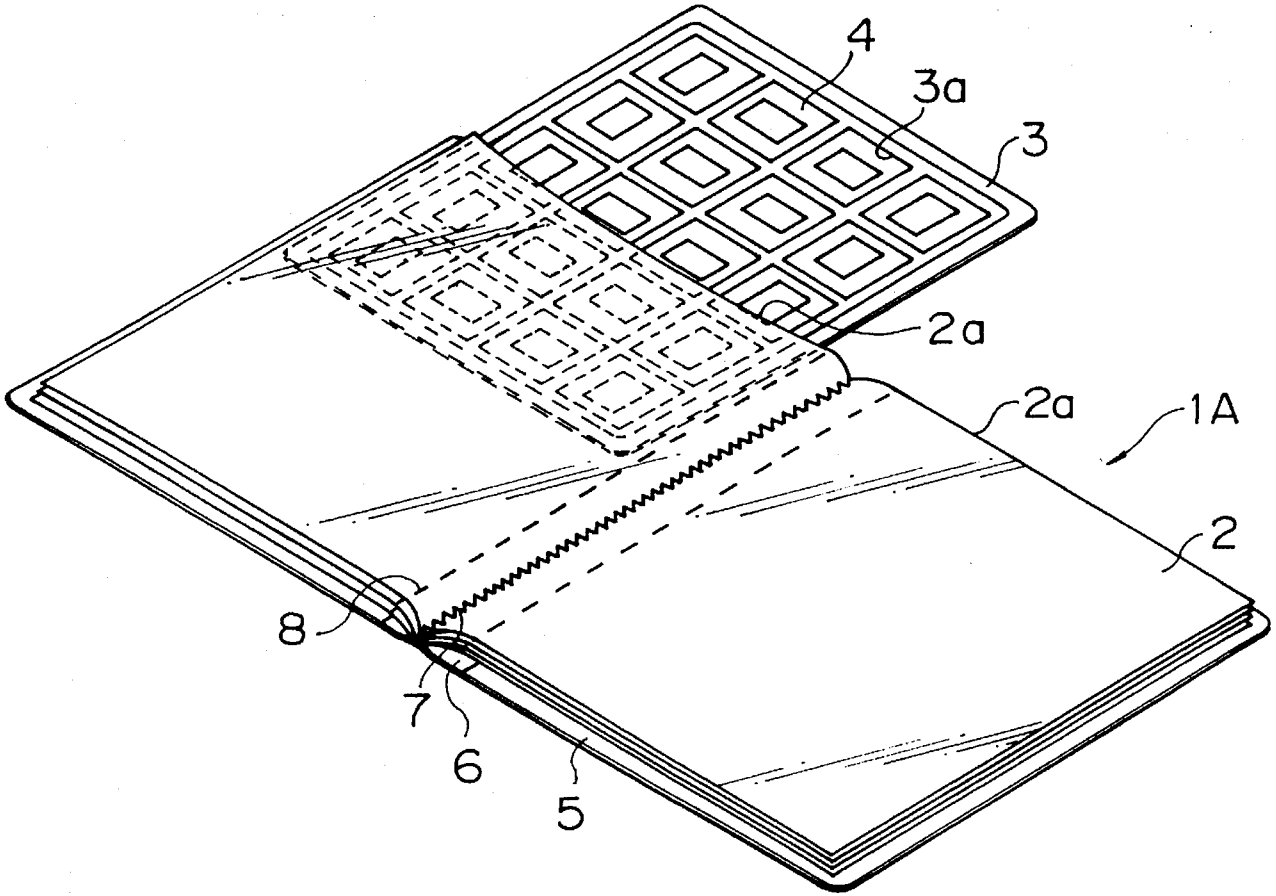
FIG. 1 is a perspective view of a file sheet storing device in accordance with one embodiment of the present invention.
Figure 2:
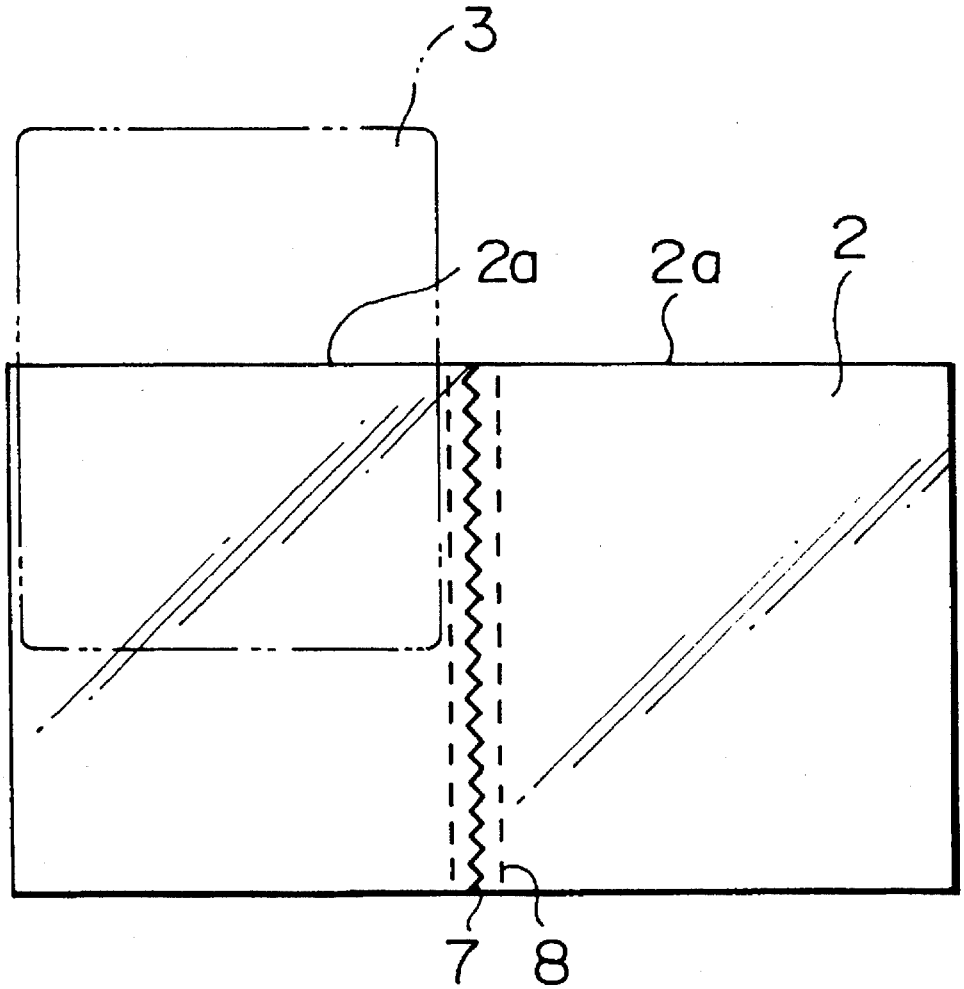
FIG. 2 is a front view of the file sheet storing device shown in FIG. 1.

Referring to the drawings, particularly to FIGS. 1 and 2, there is shown a first embodiment of the present invention. In FIG. 1, a file sheet 3 is shown as being the one which is shown and described in the aforementioned U.S. Pat. No. 4,997,089. The file sheet 3 includes a plurality of storing recesses 3*a* arranged in rows and columns. Each of the storing recesses 3*a* is of a rectangular shape for storing a picture slide 4 having a cardboard mount as in a conventional picture slide.

There is provided a slide storing device 1A which comprises a rectangular bag or cover 2 made of a transparent material. The cover 2 is formed at one side edge portion with an opening 2*a* for inserting the file sheet 3. Along an edge portion adjacent at the opening 2*a* is provided with a binding means 7 for binding the cover 2 in a book type binder having a binder cover 5 and a binder back 6. It will be understood in FIG. 1 that a plurality of similar covers 2 storing file sheets 3 are bound in the same book type binder.

In the embodiment shown in FIGS. 1 and 2, the binding means 7 is formed by bonding a desired number of covers such as by welding or sealing one cover 2 to another. In each cover 2, there is formed prevention means 8 along a line which is adjacent to but inwardly away by a predetermined distance from the edge portion where the binding means 7 is formed. The prevention means 8 is formed in this embodiment by welding together front and back sheets of the cover 2 intermittently along the line which is inwardly spaced from and parallel with the edge portion where the binding means 7 is formed. The location of the prevention means 8 is determined so that the bag-shaped cover 2 is formed with the insertion opening 2*a* which is of a width just sufficient for the insertion of the file sheet 3 into the cover 2. There must be a distance between the prevention means 8 and the binding means 7 which will allow a cover 2 to be turned over another without any difficulty even when all covers 2 are filled with the file sheets 3 of a rigid structure.

In the structure of this embodiment, the file sheet can be inserted into the cover 2 through the opening 2*a* as shown in FIG. 1. The prevention means 8 formed by the welded line 8 serves to restrict sideward movement of the file sheet 3 in the cover 2 so that the file sheet 3 is prevented from being shifted toward the binding means 7. Therefore, even when all of the covers 2 are filled with the file sheets 3 so that the covers 2 are thickened at the portions adjacent to the binding means 7, the edge portions of the file sheets 3 do not interfere with each other both in the open and closed positions of the binder.

Figure 3:
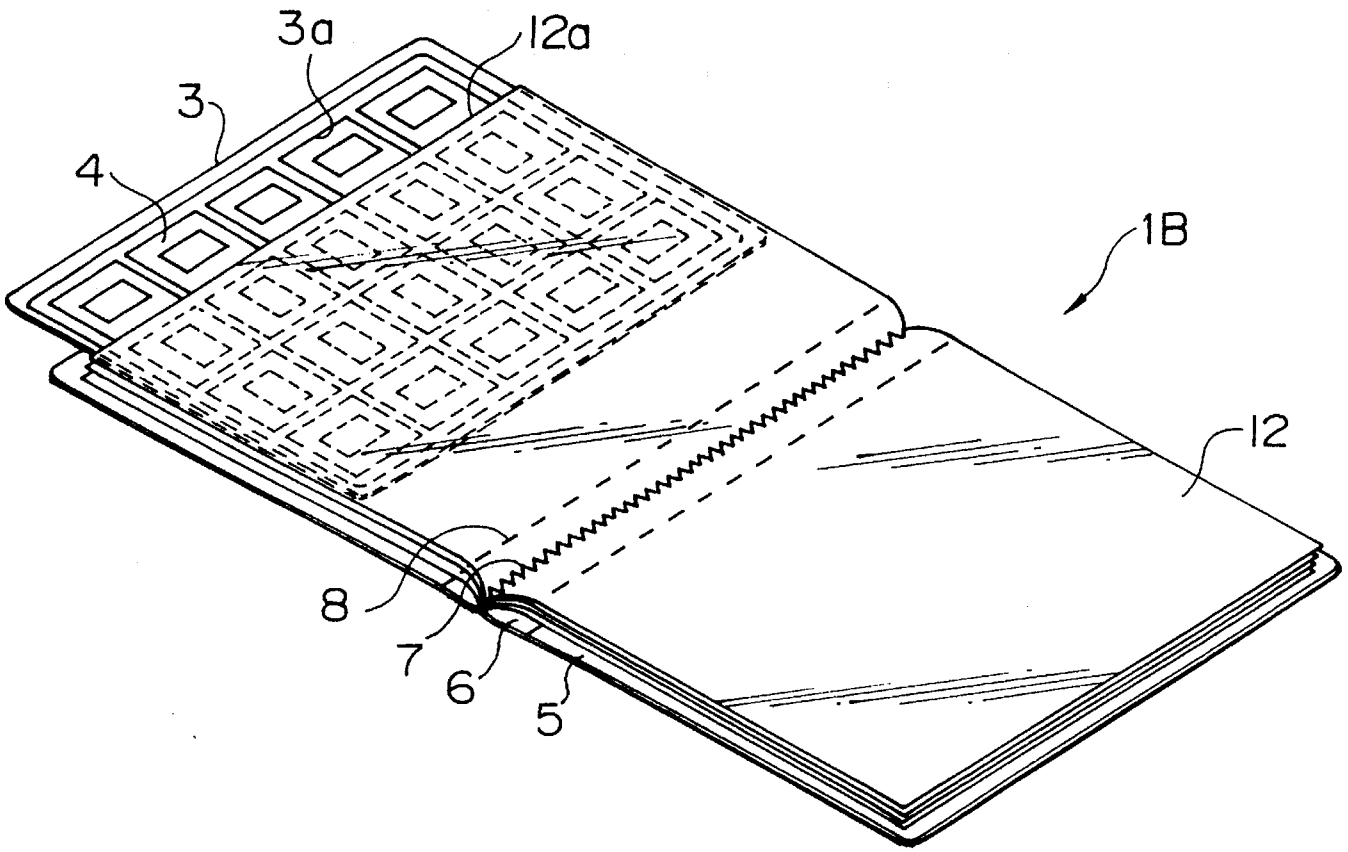
FIG. 3 is a perspective view of a file sheet storing device in accordance with another embodiment of the present invention.
Figure 4:
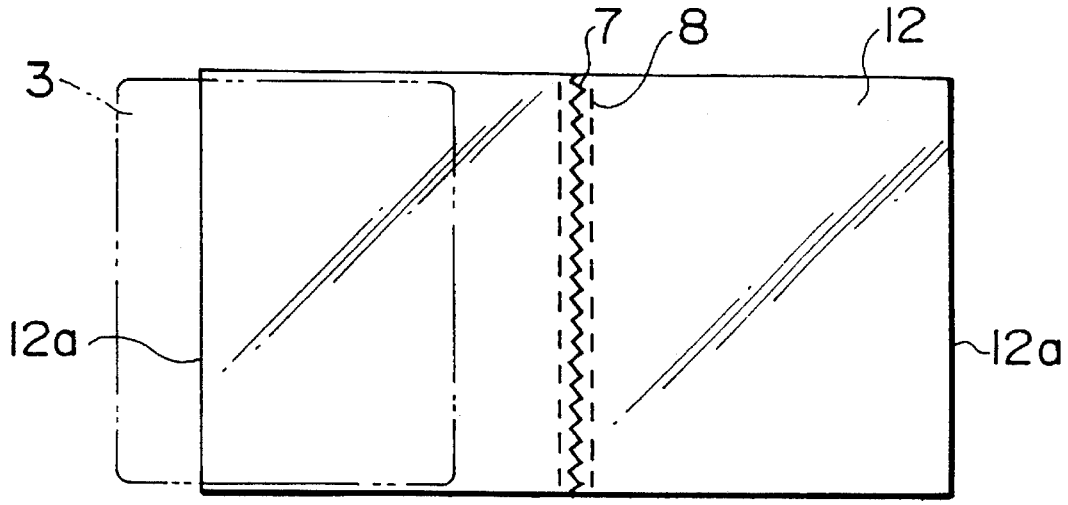
FIG. 4 is a front view of the file sheet storing device shown in FIG. 3.

Referring now to FIGS. 3 and 4, there is shown a second embodiment of the present invention which is substantially identical to the previous embodiment except that the bag or cover 12 is formed with an opening 12*a* at a side opposite to the side where the binding means 7 is formed for inserting a file sheet 3. The cover 12 is formed with prevention means 8 which is formed in a similar way as in the previous embodiment. In other respects, the structure is the same as in the previous embodiment so that detailed description will be omitted.

Figure 5:
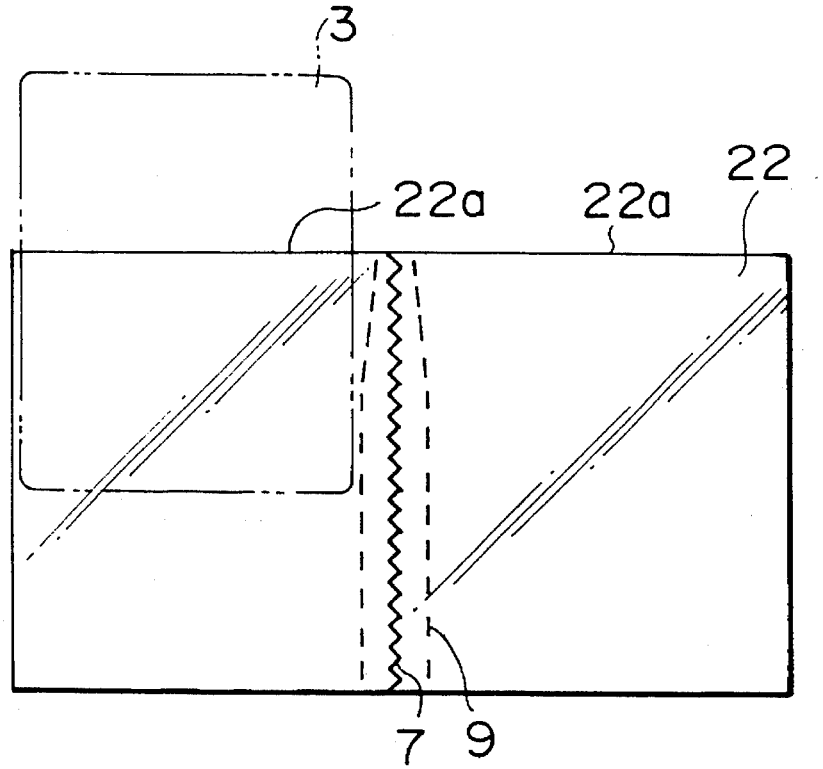
FIG. 5 is a front view of a file sheet storing device in accordance with a further different embodiment of the present invention.

In FIG. 5, there is shown a third embodiment of the present invention. In this embodiment, the bag-shaped cover 22 is formed with an opening 22*a* at a side perpendicular to the side where the binding means 7 is formed for inserting a file sheet 3. The cover 22 is formed with prevention means 9 which is provided along a line extending from a position closest to the binding means 7 at an end where the opening 22*a* is formed so that a sufficient width of entrance is ensured. The line of the prevention means 9 extends in this embodiment gradually apart away from the binding means 7 toward the direction of insertion of the file sheet 3 and then extends substantially in parallel with the binding means 7.

Figure 6:
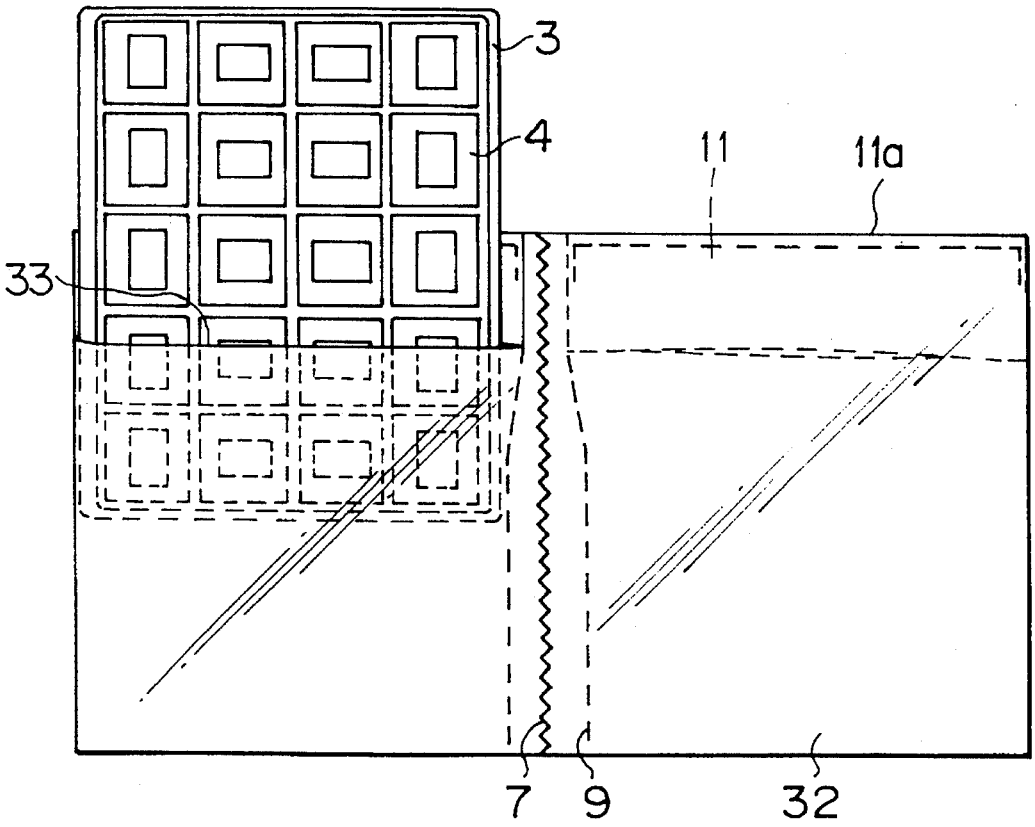
FIG. 6 is a front view of a file sheet storing device in accordance with still another embodiment of the present invention.
Figure 7A:
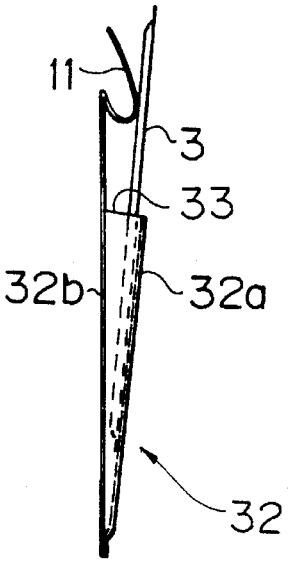
FIG. 7 (*a*) is a fragmentary side view of the file sheet storing device shown in FIG. 6 with a file sheet being in a stage of insertion.
Figure 7B:
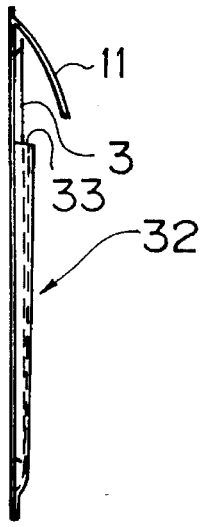

Referring to FIGS. 6 and 7 which show a fourth embodiment of the present invention, the bag-shaped cover 32 of this embodiment includes an insertion opening 33 formed at a portion offset from an edge portion of the cover by a predetermined distance toward the direction of insertion of the file sheet 3. As shown in FIG. 7, the cover 32 is formed by a front sheet 32*a* and a back sheet 32*b* which are bonded together at three sides of the front sheet 32*a*. The front sheet 32*a* is shorter than the back sheet 32*b* so that the front sheet 32*a* terminates at the upper edge portion located a certain distance lower than the upper edge portion of the back sheet 32*b* to form the aforementioned insertion opening 33. The back sheet 32*b* is provided at the upper end portion with a flap 11 for covering a portion of the file sheet 3 which projects beyond the upper edge portion of the front sheet 32*a*. The flap 11 is connected to the back sheet 32*b* by welding along a welding line 11*a* as shown in FIG. 6.

As shown in FIG. 6, the welding line 11*a* is extended at the opposite end portions along side edge portions of the back sheet 32*b*. With this configuration of the welding line 11*a*, the flap 11 is biased toward downward as shown in FIGS. 7(*a*) and 7(*b*). In this embodiment, the front sheet 32*a* and the flap 11 are formed by a transparent material and the back sheet 32*b* may be formed by an opaque material. The line of the prevention means 9 may be formed in a way similar to that in the third embodiment shown in FIG. 5.

Figure 8:
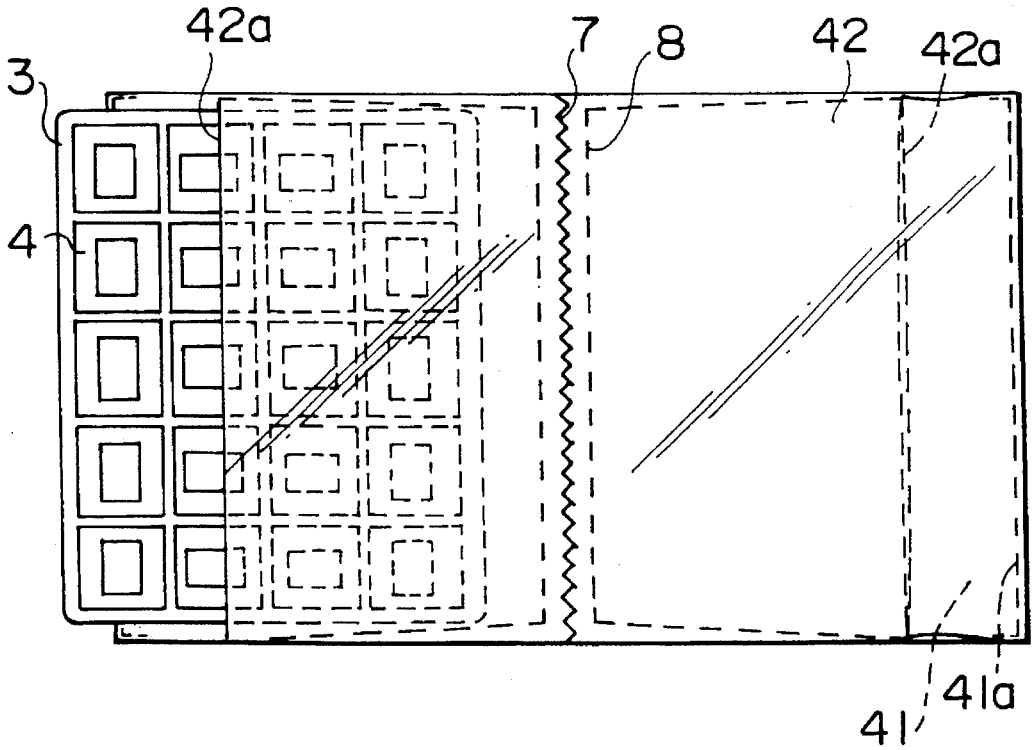

Referring to FIG. 8, there is shown a further embodiment of the present invention. In this embodiment, the bag-shaped cover 42 is formed with an insertion opening 42*a* at a side opposite to the side where the binding means 7 is formed. As in the previous embodiment shown in FIGS. 6 and 7, the front sheet of the cover 42 is smaller in width than the back sheet so that the insertion opening 42*a* is offset sidewardly from the outer side edge of the cover. A flap 41 is formed at the outer side edge portion of the cover 42 and attached to the adjacent edge of the back sheet along a welding line 41*a* in a way similar to that of the flap 11 in the previous embodiment. The prevention means 8 is formed in this embodiment in a way similar to the embodiment shown in FIG. 1.

The present invention has been shown and described with reference to preferred structures, however, it should be noted that the invention is in no way limited to the details of the illustrated structures but changes and modifications may be made without departing from the scope of the appended claims.

I claim:

1. A file sheet storing device comprising:

a plurality of transparent bag-shaped covers each being adapted for storing a file sheet for storing a plurality of planar information carrying mediums in rows and columns in a plane, each of the covers including a first sheet adapted for covering one side surface of the file sheet and a second sheet adapted for covering the other side surface of the file sheet, the first and second sheets being connected together at three edge portions to form a configuration of a bag with opening means formed along the remaining edge portion for inserting the file sheet, each of the covers being provided with binding means to bind the cover in a book-shaped binder along one edge portion other than the remaining edge portion where the opening means is provided, such that the opening means is formed substantially along an edge portion of the cover that is perpendicular to the edge portion where the binding means is provided, and prevention means provided in each of the covers for preventing a file sheet stored in the cover from being displaced toward the edge portion of the cover where the binding means is formed, the prevention means being formed by a line of attachment between the first and the second sheets of the cover, the line extending substantially in parallel with and spaced by a predetermined distance from the binding means, wherein the line of attachment is located closer to the edge portion where the binding means is provided at a location adjacent to the opening means to provide a wider opening for the insertion of the file sheet and extending gradually away from the binding means along the direction of insertion of the file sheet through the opening means to narrow the space for inserting the file sheet into the cover.

2. A file sheet storing device in accordance with claim 1 in which the first sheet of the cover is smaller in length than the second sheet so that the opening means is offset by a predetermined distance from the corresponding edge portion of the second sheet of the cover.

3. A file sheet storing device in accordance with claim 2 in which the second sheet is formed with a flap along the corresponding edge portion of the second sheet adjacent to the opening means.

4. A file sheet storing device in accordance with claim 3 in which the flap is provided with means for biasing the flap in a closing direction.

5. A file sheet storing device in accordance with claim 1 in which one of the first and second sheets of each cover is transparent, and the other of the first and second sheets of each cover is opaque.

* * * * *